US008742604B2

(12) United States Patent
Dyer et al.

(10) Patent No.: US 8,742,604 B2
(45) Date of Patent: Jun. 3, 2014

(54) SYSTEMS AND METHODS FOR COMBINED FLOW CONTROL AND ELECTRICITY GENERATION

(75) Inventors: Timothy Dyer, San Leandro, CA (US); Mark Richter, Orinda, CA (US); Rafael Andres Bañados Contreras, San Leandro, CA (US); Chester L. Sandberg, Palo Alto, CA (US)

(73) Assignee: Energy Recovery, Inc., San Leandro, CA (US)

( * ) Notice: Subject to any disclaimer, the term of this patent is extended or adjusted under 35 U.S.C. 154(b) by 44 days.

(21) Appl. No.: 13/489,708

(22) Filed: Jun. 6, 2012

(65) Prior Publication Data

US 2013/0328310 A1 Dec. 12, 2013

(51) Int. Cl.
*F01K 25/02* (2006.01)

(52) U.S. Cl.
USPC ..... 290/1 A

(58) Field of Classification Search
USPC ..... 290/54; 60/645
See application file for complete search history.

(56) References Cited

U.S. PATENT DOCUMENTS

| | | | | |
|---|---|---|---|---|
| 3,599,424 | A * | 8/1971 | Yampolsky | 376/378 |
| 4,079,263 | A * | 3/1978 | Inoue | 290/52 |
| 4,118,637 | A * | 10/1978 | Tackett | 290/55 |
| 4,122,381 | A * | 10/1978 | Sturm | 320/128 |
| 4,149,092 | A * | 4/1979 | Cros | 290/54 |
| 4,352,025 | A * | 9/1982 | Troyen | 290/54 |
| 4,387,575 | A * | 6/1983 | Wenzel | 60/648 |
| 4,496,845 | A * | 1/1985 | Ensign et al. | 290/43 |
| 4,731,545 | A * | 3/1988 | Lerner et al. | 290/54 |
| 4,746,808 | A * | 5/1988 | Kaeser | 290/52 |
| 5,754,613 | A * | 5/1998 | Hashiguchi et al. | 376/378 |
| 6,765,308 | B1 * | 7/2004 | Kazanjian et al. | 290/43 |
| 7,019,412 | B2 * | 3/2006 | Ruggieri et al. | 290/2 |
| 7,406,830 | B2 * | 8/2008 | Valentian et al. | 62/50.2 |
| 7,632,040 | B2 * | 12/2009 | Cripps | 405/75 |
| 7,768,146 | B2 * | 8/2010 | Balzano | 290/54 |
| 2002/0021008 | A1 * | 2/2002 | Hurley | 290/54 |
| 2004/0194499 | A1 * | 10/2004 | Grenfell | 62/612 |
| 2007/0234702 | A1 * | 10/2007 | Hagen et al. | 60/39.01 |
| 2009/0277400 | A1 * | 11/2009 | Conry | 123/2 |
| 2010/0156112 | A1 * | 6/2010 | Held et al. | 290/1 A |
| 2012/0326443 | A1 * | 12/2012 | Vince et al. | 290/7 |

FOREIGN PATENT DOCUMENTS

| | | | |
|---|---|---|---|
| JP | 57065498 | A * | 4/1982 |
| JP | 07217800 | A * | 8/1995 |
| JP | 2003139039 | A * | 5/2003 |

* cited by examiner

*Primary Examiner* — Joseph Waks
(74) *Attorney, Agent, or Firm* — Fletcher Yoder, P.C.

(57) ABSTRACT

Systems and methods for combined flow control and electricity generation are described. Various embodiments may include an energy recovery device adapted to produce an electric current. At least a portion of the electric current may be used to power a pump. A control system may be adapted to adjust operating parameters of the system to stabilize or maximize the efficiency of the energy recovery device.

22 Claims, 5 Drawing Sheets

SYSTEMS AND METHODS FOR COMBINED FLOW CONTROL AND ELECTRICITY GENERATION

FIELD OF THE INVENTION

The present invention is directed generally to conversion of mechanical energy to electrical energy, and more specifically to using the energy conversion to control the flow or pressure of a stream.

BACKGROUND

A number of industries produce or make use of high pressure or high flow streams. These high pressure/flow streams may contain a significant amount of energy. Often these streams are of a lower quality or quantity such that energy recovery methods are not economically feasible. Consequently, these streams are often discharged and the potential energy of the streams is lost.

In addition to economic considerations, there may be a variety of other reasons why the recovery of energy from these streams is considered impractical. For example, the stream may contain contaminates that make energy recovery hazardous, such as explosive fluids or gases. Other streams may contain contaminates that may damage equipment through corrosion or abrasion.

SUMMARY

Systems and methods for combined flow control and electricity generation are described. Various embodiments may comprise a turbine driven by a high pressure inlet stream. A generator may be coupled to the turbine to produce an electric current. At least a portion of the electric current may be used to power a motor, and a pump may be coupled to the motor. A control system may be adapted to sense operating parameters of the turbine. The control system may adjust operating parameters of one or both of the generator and motor to modify the operation of the turbine.

DETAILED DESCRIPTION

The present application is directed to systems and methods for combined flow control and electricity generation. Various embodiments may comprise a turbine driven by a high pressure inlet stream. A generator may be coupled to the turbine to produce an electric current. At least a portion of the electric current may be used to power a motor, and a pump may be coupled to the motor. A control system may be adapted to sense any of the turbine inlet and outlet pressures and flow. The control system may then adjust operating parameters of one or both of the generator and motor to stabilize the turbine or maximize the efficiency of the turbine.

Figure 1:
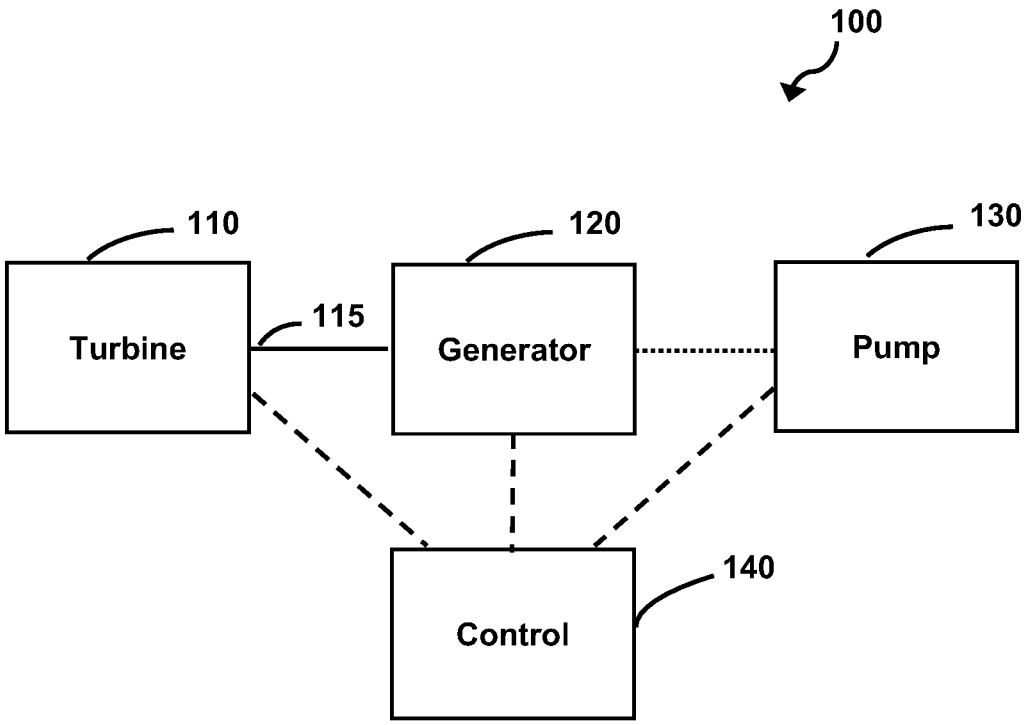
FIG. 1 is a schematic drawing of a combined flow control and electricity generation system.

FIG. 1 schematically illustrates various embodiments of a combined flow control and electricity generation system 100. A turbine 110 may be coupled to a generator 120 such that rotation of the turbine 110 causes rotation of the generator 120, thereby producing an electric current. The turbine 110 may comprise a shaft 115 that is coupled to the generator 120, or there may be a system of gears (not shown) between the turbine 110 and the generator 120 such that one rotation of the turbine 110 results in more or less than one rotation of the generator 120. The electric current may be used to power a pump 130. In various embodiments, the pump 130 may be configured to interact with the turbine 110, while in other embodiments the pump 130 and turbine 110 operate independently.

In various embodiments, a control system 140 monitors operation of the system 100. For example, the control system 140 may sense turbine inlet flow and pressure, or turbine outlet flow and pressure, or any combination of these or other parameters of any component of the system 100. In order to achieve a desired turbine output, the control system 140 may adjust the operating parameters of the components of the system 100 to achieve the desired turbine 110 output.

Figure 2:
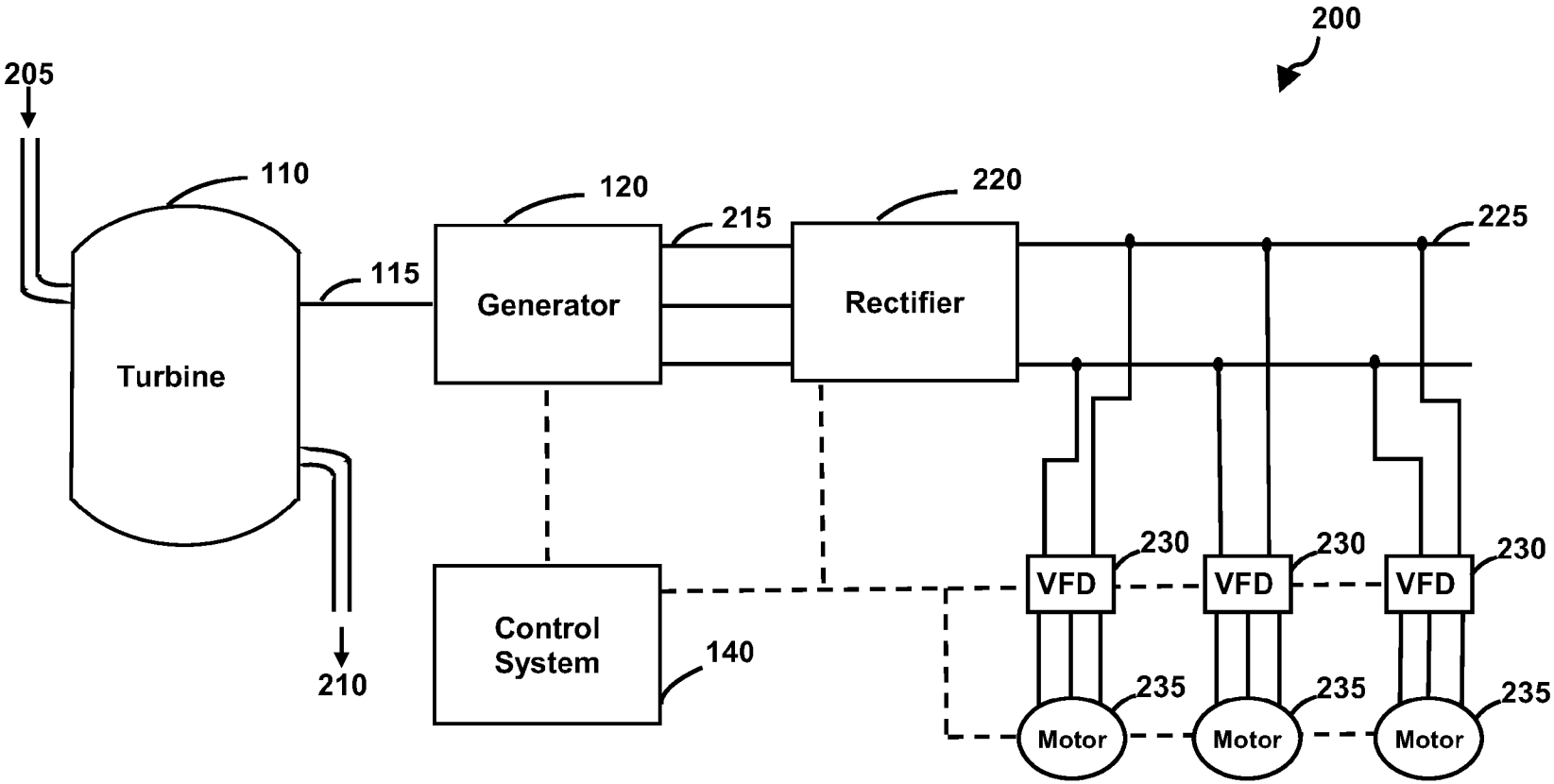
FIG. 2 is a schematic drawing of a combined flow control and electricity generation system.

FIG. 2 further illustrates a flow control and electricity generation system 200 according to various embodiments. The turbine 110 comprises an input stream 205 and an outlet stream 210. The turbine input stream 210 may be a high pressure stream with sufficient energy to drive the turbine 110 with sufficient rotational torque to power the generator 120 to produce a desired amount of electricity. As discussed in further detail below, the turbine input stream 205 may originate from a variety of sources. The turbine outlet stream 210 may be a lower pressure or energy level than the input stream 205, as the turbine 110 may function to remove energy from the input stream 205.

The generator 120 may be an electric generator providing three-phase alternating current (AC) output 215. The AC may be generated at various frequencies and voltages as needed by the system 200. The generator 120 may be of any type or design as known in the art to convert mechanical energy to electrical energy. For example, the generator 120 may comprise a rotor having a core with a plurality of current-carrying coils wound on the core, and a stator carrying a winding. A magnetic field may be generated by passing a current along the rotor coils such that a current is induced in the coils of the stator winding when the rotor is rotated. The generator 120 may be synchronous or asynchronous, use permanent magnets or electromagnets, have a stationary or rotating field, and may produce single or multi-phase power.

A rectifier 220 may be configured to receive the AC output 215 of the generator 215. The rectifier 220 may rectify the AC output 215 to substantially direct current (DC) and supply the DC to a DC bus 225. The rectifier 220 may comprise diodes, transistors, silicon controlled rectifiers, thyristors, or other rectifying elements and may be active or passive. The DC bus 225 may be used to supply DC to a number of devices.

FIG. 2 illustrates a single turbine 110, generator 120, and rectifier 220. It is understood that the scope of the present disclosure covers systems comprising multiple turbines 110, generators 120, and rectifiers 220. Further, the number of each of these components may be the same or may be different. For example, various embodiments may comprise multiple turbines 110, generators 120, and rectifiers 220 feeding a common DC bus 225. In this example, the system may include any necessary circuitry and switching components to integrate the multiple turbines 110 and generators 120.

The DC bus 225 may be used to power one or more motors 235. Various embodiments may also comprise a variable frequency drive (VFD) 230 when the motor 235 is a three-phase motor. The VFD 230 may separate the DC into three outputs 120 degrees out of phase. The motors see this output as AC. The VFD 230 may be used to reduce power consumption when the motor 235 is first started, as well as to vary the speed of the motor 235 after startup. The VFD 230 may initially apply a low frequency (2 Hz or less) and voltage to the motor 235 during startup. This avoids the sudden and high inrush of current that may otherwise occur when full line current is applied to a motor. Once the motor 235 begins spinning, the VFD 230 may increase the applied frequency and voltage at a controlled rate. During operation of the motor 235, the VFD 230 may function as a motor speed control device. Varying an output voltage of the VFD 230 may be used to vary the speed of the motor 235. Thus, the speed of the motor 235 may be adjusted to more closely match the demand on the motor 235.

FIG. 2 illustrates three VFDs 230 and motors 235 electrically coupled to the DC bus 225. Either more or less than three VFDs 230 and motors 235 may be used as specific applications require. For example, the various embodiments illustrated in FIG. 3 comprise a single VFD 230 and motor 235.

The rectifier 220 and VFD 230 in various embodiments may be combined into a single component. In such a case, the DC bus 225 may be omitted, as the three-phase power may be supplied directly from the combined rectifier-VFD component. In various embodiments, the VFD 230 may regenerate the power directly to a power grid 310. For example, the generator 120 may be connected to the VFD 230 that acts as a rectifier and inverter outputting AC power. This AC power may be fed to the power grid 310 and used by any load on the grid 310.

The control system 140 may be used to optimize the operation of the system 200. Initially, the control system 140 may signal the VFD 230 to begin providing current to motor 235 to start up the motor 235 as described above. Once the motor 235 has completed startup, the control system 140 may monitor the operation of the generator 120 and rectifier 220 (as well as any other relevant components within or outside of the system 200) by monitoring voltage, frequency, or amperage at any point in the system 200. Based on the results of this monitoring, the control system 140 may signal the VFD 230 to vary the power delivered to the motor 235, thereby either slowing down or speeding up the motor 235 as the situation requires.

Figure 3:
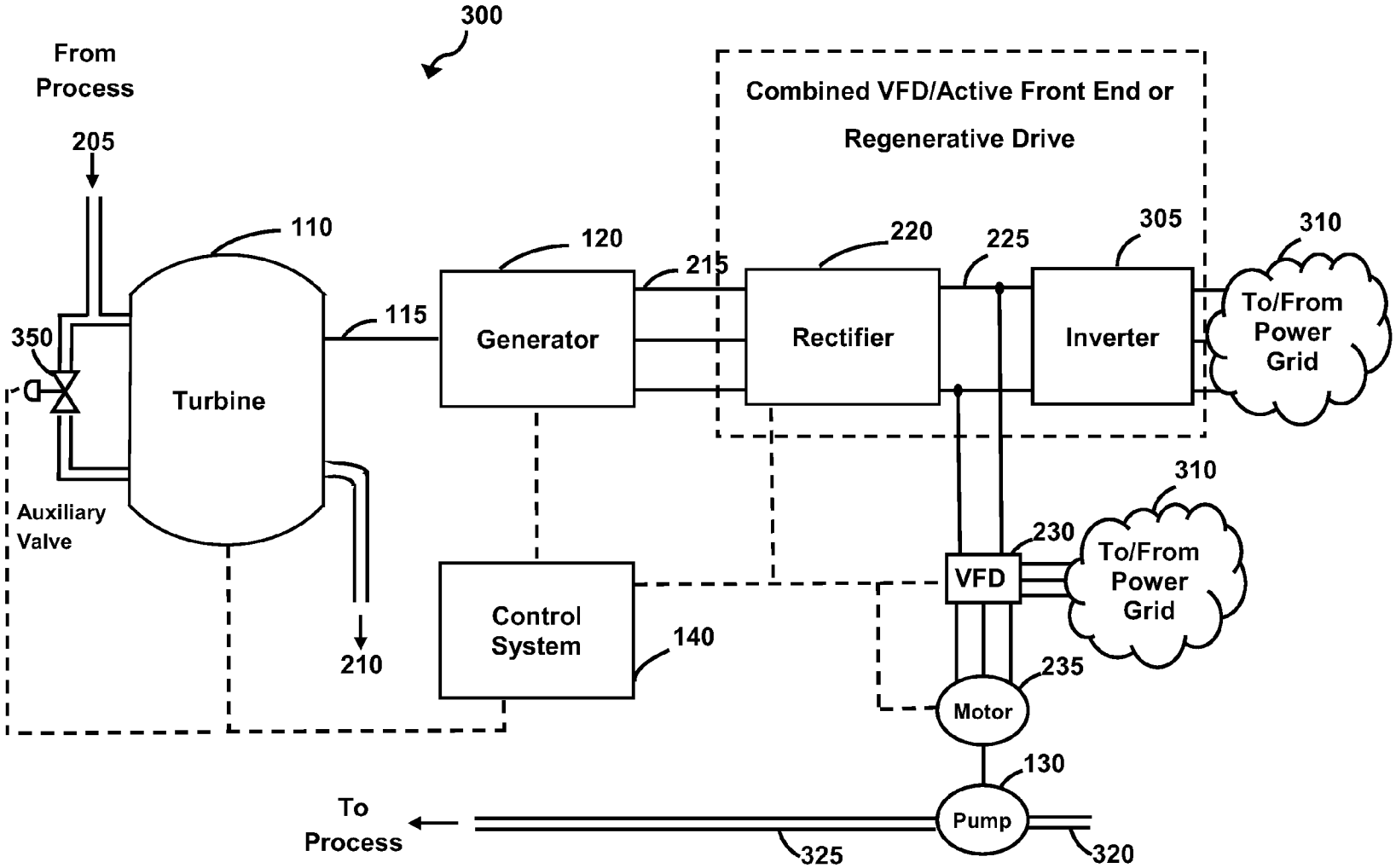
FIG. 3 is a schematic drawing of another combined flow control and electricity generation system.

FIG. 3 illustrates various embodiments of a flow control and electricity generation system 300. The turbine 110, generator 120, generator AC output 215, rectifier 220, DC bus 225, VFD 230, and motor 235 function substantially as described previously for FIG. 2. In the various embodiments of FIG. 3, the pump 130 may be driven by the motor 235. In general, the pump 130 has an input stream 320 and an outlet stream 325 such that a pressure of the outlet stream 325 is greater than a pressure of the inlet stream 320.

At least a portion of the pump outlet stream 325 may be directed to the turbine inlet stream 205 to supplement the flow or pressure of the turbine inlet stream 205. Valves 330, 335 may be adjusted to direct any portion of the flow either to the turbine inlet stream 205 or to bypass the turbine 110. The amount of the pump outlet stream 325 directed to the turbine inlet stream 205 may be determined and controlled by the control system 140.

The control system 140 may monitor various parameters of the system 300 and adjust the operation of the system 300 to achieve one or more predetermined set points. For example, one such set point may be to maintain the efficiency of the turbine 110 at a predetermined value. The control system may monitor the inlet and outlet pressures and the flow rate of the turbine 110. Based on the differential pressure and the flow rate, the control system may adjust the speed of the turbine to a speed that achieves maximum generation efficiency for those pressure and flow conditions.

Alternatively, the turbine inlet stream 205 flow rate may be decreased, causing a slowing in the speed of the turbine 110 and a subsequent decrease in generating efficiency. The control system 140 may again monitor the inlet and outlet pressure and flow rate of the turbine 110 and determine a new operating speed to maximize generating efficiency for the current pressure and flow conditions. Additional flow control schemes (such as auxiliary valve 350 or the like) may be added to optimize the efficiency of the turbine.

In various embodiments, the control system may adjust the load on the generator to affect a change in the flow rate of the turbine 110. For example, when the turbine inlet stream 205 flow rate increases beyond a predetermined value, the control system 140 may direct the system 300 to produce a greater amount of electric energy. As the generator 120 attempts to meet this demand, the generator 120 extracts more energy from the turbine 110 and the turbine 110 may slow down. This process may result in more energy extracted from the turbine inlet stream 205, which may also result in a decrease of the turbine inlet steam 205 flow rate. The process flow rate may also be controlled by a throttle valve installed before or after the turbine.

The control system 140 may also be adapted to maximize the efficiency of the turbine 110 while controlling the flow of the turbine inlet stream 205. The pump outlet stream 325 may be available to supplement the turbine inlet stream 205 or may be directly injected into the turbine 110. The control system 140 may adjust the valves 330, 335 to allow the pump outlet steam 325 to supplement the turbine inlet stream 205, or to completely or partially bypass the turbine 110.

As the control system 140 adjusts the operation of the system 300, the generator 120 may produce more electricity than can be consumed by components electrically coupled to the DC bus 225. Therefore, the system 300 may include an inverter 305 to convert the DC to AC such that the AC can be directed to the power grid 310. The inverter 305 may include filtering or other frequency and voltage adjustment to properly condition the AC for the power grid 310. In other situations, the generator 120 may be producing less electricity than required to run the motor 235 at the desired speed. The system 300 may include a connection to the power grid 310 to draw supplemental electrical energy. Although FIG. 3 illustrates that the power grid 310 supplies electrical energy directly to the VFD 230, the electrical energy could be supplied at other points within the system 300.

Figure 4:
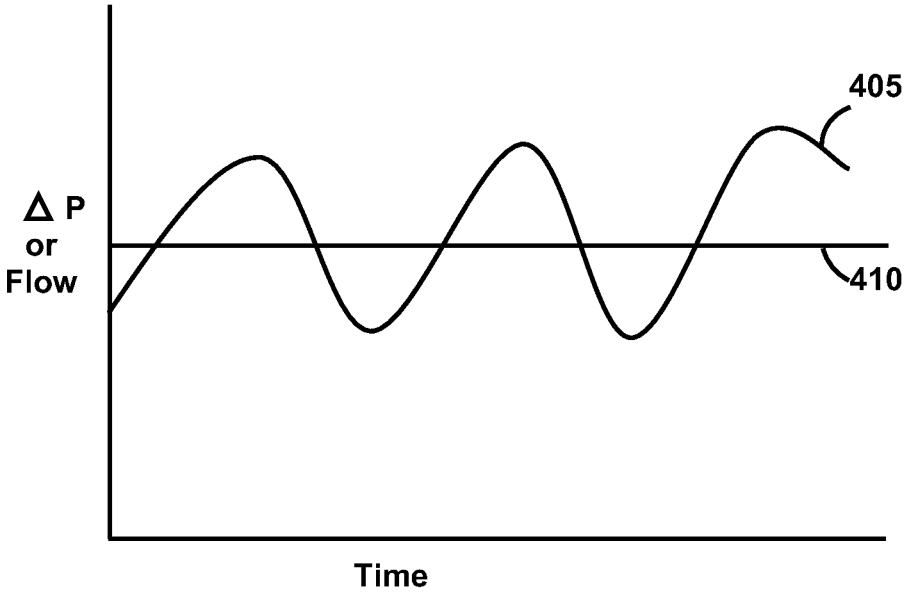
FIG. 4 is a graph illustrating how the pressure drop or flow of a stream may vary over time.
Figure 5:
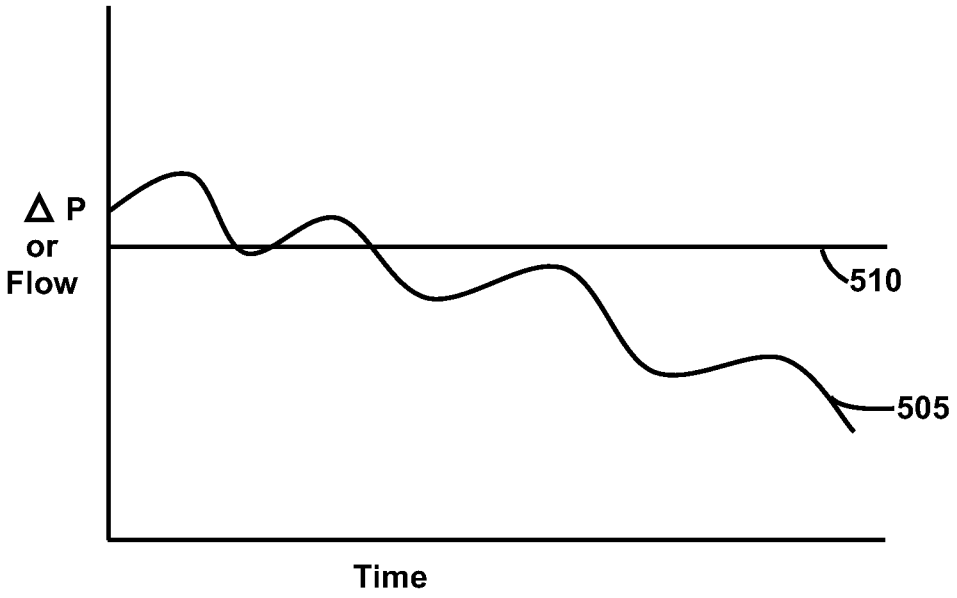
FIG. 5 is a graph illustrating another scenario of how the pressure drop or flow of a stream may vary over time.

In general, various embodiments of the system 300 may be used to produce an essentially steady-state flow or pressure drop across the turbine 110 when operated as described above. FIG. 4 illustrates a situation where the uncontrolled stream 405 may vary between a maximum and a minimum over time. Use of the system 300 may achieve a desired steady-state condition 410. Another situation is illustrated in FIG. 5 in which the uncontrolled stream 505 not only varies between a maximum and a minimum value, but the maximum and minimum values decrease over time resulting in an overall decrease in flow or pressure drop over time. Various embodiments of the system 300 may be used to supplement the turbine inlet stream 205 when the maximum value of the uncontrolled stream 505 falls below a desired steady-state condition 510.

The system 300 provides a separation between the turbine 110 and the pump 130. While it is known in the art to directly drive the pump 130 by the turbine 110, such an arrangement may have the potential to allow mixing of the fluid driving the turbine 110 and the fluid moved by the pump 130. Shaft seals may leak over time allowing transfer of fluid between the turbine 110 and the pump 130. In contrast, the system 300 decouples the turbine 110 and pump 130 such that no fluid transfer may occur. The decoupling of the turbine 110 and the pump 130 also allows the turbine 110 and pump 130 to operate at different speeds independent of one another. Thus, the system 300 may be operated such that the turbine 110 predominantly runs at a speed that may maximize efficiency, regardless of the demands on the pump 130.

Figure 6:
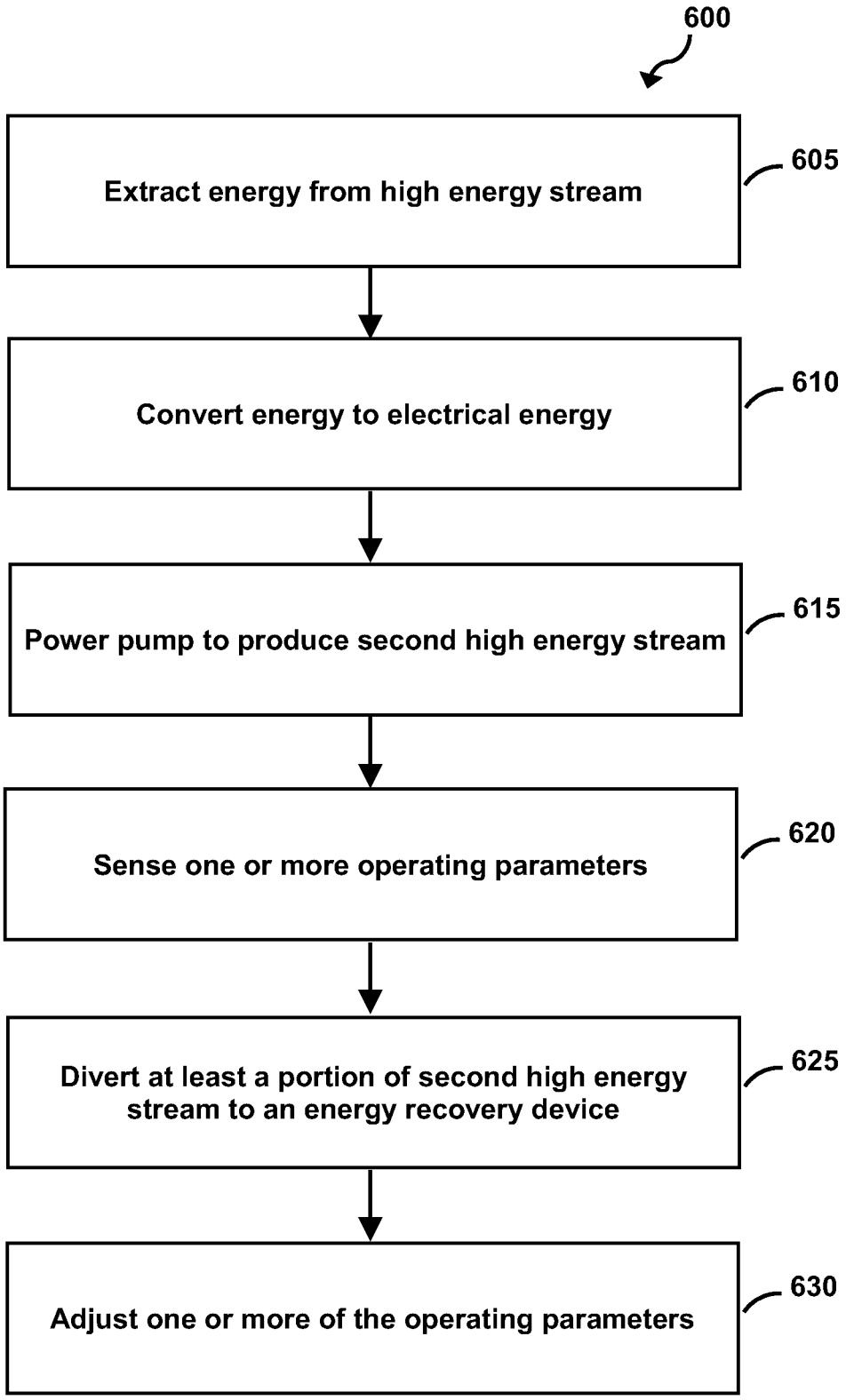
FIG. 6 is a flow diagram of a method for combined flow control and electricity generation.

In FIG. 6, various embodiments of a method of the present disclosure are exemplified by method 600. Energy may be extracted from a high energy stream (step 605) (e.g., the turbine inlet stream 205) using an energy recovery device. The extracted energy may be converted to electrical energy (step 610). As illustrated in FIG. 3, the conversion may comprise several steps. In various embodiments, mechanical energy may be extracted from the high energy stream by the turbine 110. The turbine 110 may be coupled to a generator 120 such that rotation of the turbine 110 results in rotation of the generator 120. The generator 120 may include a rotor and stator configured such that rotation of one or the other produces a three-phase AC output 215. The rectifier 220 may condition the AC output 215 to DC and supply the DC to the DC bus 225.

At step 615, the electrical energy may be used to supplement the power to the pump 130 to produce a second high pressure stream (pump outlet stream 325). The VFD 230 may be electrically coupled to the DC bus 225. The VFD 225 may separate the DC into three outputs 120 degrees out of phase (i.e., an AC output). The VFD 225 output may power a three-phase motor 235 coupled to the pump 130.

At step 620, the control system 140 may sense and monitor a variety of operating parameters throughout the system. Using this information, the control system 140 may divert at least a portion of the second high pressure stream 325 to the energy recovery device to produce conditions within the energy recovery device that may increase operating efficiency (step 625). Additionally, the control system 140 may adjust one or more of the operating parameters to control operation of the system. For example, the control system 140 may adjust one or more operating parameters to stabilize the pressure or flow of the high energy stream.

As stated above, various embodiments of the present disclosure may have application in a variety of industries, such as desalination, mining, and oil and gas processing. Many desalination processes employ reverse osmosis (RO) systems. The reject water from the RO membranes may be discharged at high pressure. The reject water stream may be the input to the turbine 110. Energy extracted from the reject water may be converted to electrical energy by the generator 120 and eventually power the motor 235 operating the pump 130. The fluid moved by the pump 130 may be the brackish water (or salt water) input to the RO system. The pump outlet stream 325 may be fed back to the turbine inlet stream 205 or to the RO system.

Certain mining operations occur at high elevations. Due to the terrain at these elevations, it may not be feasible to construct processing facilities for the mined product. It also may not be feasible to construct the roads that would be required to haul the mining product to the processing facilities. In such a situation, a pipeline may be used to transport the mining product from the mine down to the processing facility, often in a slurry. The pipeline may rely on gravity feed to move the slurry down the pipeline. The flow rate of the slurry is often critical. If the flow rate is too low, the solids in the slurry may coalesce and form a plug. At higher flow rates, the abrasive action of the slurry within the pipeline increases and may lead to premature failure of the pipeline. Various embodiments may be used to extract the energy of the high speed slurry, thereby generating electrical energy while controlling flow.

In the oil and gas production industry, oil and gas extracted from the earth are often at high pressure. This pressure must be reduced during the extraction processes so that the oil and gas can be further processed. Rather than simply dissipating the pressure, various embodiments may be used to recover the energy in the high pressure stream, convert that energy to electrical energy, and control the pressure drop of the high pressure stream.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise.

The above description is illustrative and not restrictive. Many variations of the invention will become apparent to those of skill in the art upon review of this disclosure. The scope of the invention should, therefore, be determined not with reference to the above description, but instead should be determined with reference to the appended claims along with their full scope of equivalents.

What is claimed is:

1. A combined flow control and electricity generation system, comprising:

a turbine driven by a high pressure inlet stream;

a generator coupled to the turbine to produce an electric current;

a motor powered by at least a portion of the electric current;

a pump coupled to the motor, wherein the pump is configured to drive a second stream; and a control system that senses at least one of turbine inlet pressure, turbine outlet pressure, turbine inlet flow, or turbine outlet flow, diverts at least a portion of the second stream to the turbine with the high pressure inlet stream, and adjusts at least one operating parameter of at least one of the generator and motor to affect a change in at least one operating parameter of the turbine.

2. The system of claim 1, wherein the electric current is an alternating current (AC) or a direct current (DC).

3. The system of claim 2, comprising a rectifier to condition the AC to DC.

4. The system of claim 3, comprising a DC bus for distribution of the electric current.

5. The system of claim 4, comprising a variable frequency drive electrically coupled to the DC bus and outputting a 3-phase electric current to power the motor.

6. The system of claim 1, comprising a variable frequency drive configured to accept power from a power grid.

7. The system of claim 1, comprising a plurality of motors powered by at least a portion of the electric current.

8. The system of claim 3, comprising an inverter to condition the DC to AC suitable for supply to a power grid.

9. The system of claim 1, comprising a plurality of turbines.

10. The system of claim 1, comprising a plurality of generators and a plurality of motors, wherein a number of generators is different than a number of motors.

11. The system of claim 1, wherein the control system comprises one or more devices to measure any of the turbine inlet pressure, turbine outlet pressure, turbine inlet flow, or turbine outlet flow.

12. The system of claim 1, wherein the operating parameter of the turbine comprises generating efficiency.

13. The system of claim 1, wherein the control system is adapted to sense any of turbine inlet pressure, turbine outlet pressure, turbine inlet flow, or turbine outlet flow, and adjust one or more operating parameters of one or both of the generator and motor to affect a change in the flow rate of the turbine.

14. A combined flow control and electricity generation system, comprising:

an energy recovery device to extract energy from a first high energy stream and convert the energy to electrical energy;

a pump powered by the electrical energy to produce a second high energy stream; and a control system operative to divert at least a portion of the second high energy stream to the first high energy stream to flow through the energy recovery device, thereby increasing the operating efficiency of the energy recovery device.

15. The system of claim 14, wherein the energy recovery device comprises a turbine and a generator.

16. The system of claim 14, comprising an inverter to condition the electrical energy for distribution to a power grid.

17. The system of claim 14, wherein the control system is operative to adjust operating parameters of the system to control a flow of the high energy stream.

18. The system of claim 14, wherein the control system is operative to adjust operating parameters of the system to control a pressure drop of the first high energy stream across the energy recovery device.

19. A method for combined flow control and electricity generation, comprising:

extracting energy from a first high energy stream using an energy recovery device;

converting the energy to electrical energy;

using the electrical energy to power a pump, wherein the pump produces a second high energy stream;

diverting at least a portion of the second high energy stream to the first high energy stream to flow through the energy recovery device, thereby increasing the operating efficiency of the energy recovery device; and sensing one or more operating parameters of the system, and adjusting one or more of the operating parameters to stabilize a pressure or flow of the high energy stream.

20. The method of claim 19, wherein converting the energy to electrical energy comprises generating AC, and rectifying the AC to DC.

21. The method of claim 19, wherein using the electrical energy to power a pump comprises supplying DC to a variable frequency drive, and using an output of the variable frequency drive to power the pump.

22. The method of claim 19, wherein sensing one or more operating parameters of the system comprises sensing one or more of pressure, flow, voltage, frequency, and amperage.

* * * * *